US005123270A

United States Patent [19]

Salvagnini

[11] Patent Number: 5,123,270

[45] Date of Patent: Jun. 23, 1992

[54] BENDING UNIT OF A MACHINE FOR BENDING METAL SHEETS

[75] Inventor: Guido Salvagnini, Sarego, Italy

[73] Assignee: Salvagnini S.P.A., Sarego, Italy

[21] Appl. No.: 651,642

[22] Filed: Feb. 6, 1991

[30] Foreign Application Priority Data

Feb. 9, 1990 [IT] Italy ..... 19330 A/90

[51] Int. Cl.[5] ..... B21D 5/04

[52] U.S. Cl. ..... 72/322; 72/312

[58] Field of Search ..... 72/312, 313, 319, 322, 72/323, 316

[56] References Cited

U.S. PATENT DOCUMENTS

| | | | |
|---|---|---|---|
| 929,818 | 8/1909 | Benedek | 72/319 |
| 2,132,569 | 10/1938 | Kelleher | 72/319 |
| 2,178,926 | 11/1939 | Brickman | 72/312 |
| 3,074,461 | 1/1963 | Benedict . | |
| 3,350,912 | 11/1967 | Smith | 72/319 |
| 3,948,074 | 4/1976 | Stalzer | 72/312 |
| 3,994,152 | 11/1976 | Wolters | 72/319 |
| 4,520,646 | 6/1985 | Pauzin | 72/313 |

FOREIGN PATENT DOCUMENTS

| | | |
|---|---|---|
| 0310145 | 5/1989 | European Pat. Off. . |
| 1452813 | 5/1970 | Fed. Rep. of Germany . |
| 2163738 | 8/1972 | Fed. Rep. of Germany . |

*Primary Examiner*—Daniel C. Crane

*Attorney, Agent, or Firm*—Cushman, Darby & Cushman

[57] ABSTRACT

The bending unit includes a fixed counterblade, a metal sheet holder which, pressing on counterblade, holds one of the edges of metal sheet and a blade arranged on the same side of the metal sheet holder as the metal sheet. This blade, translating with respect to the counterblade and to the metal sheet holder, causes the displacement outside the plane of the edge of the metal sheet which is not held by counterblade and metal sheet holder. The counterblade and blade are made in a plurality of segments parallel and side by side to one another in a direction orthogonal to the plane of the metal sheet, and the metal sheet holder is so flexible as to follow the counterblade in its deflections.

3 Claims, 2 Drawing Sheets

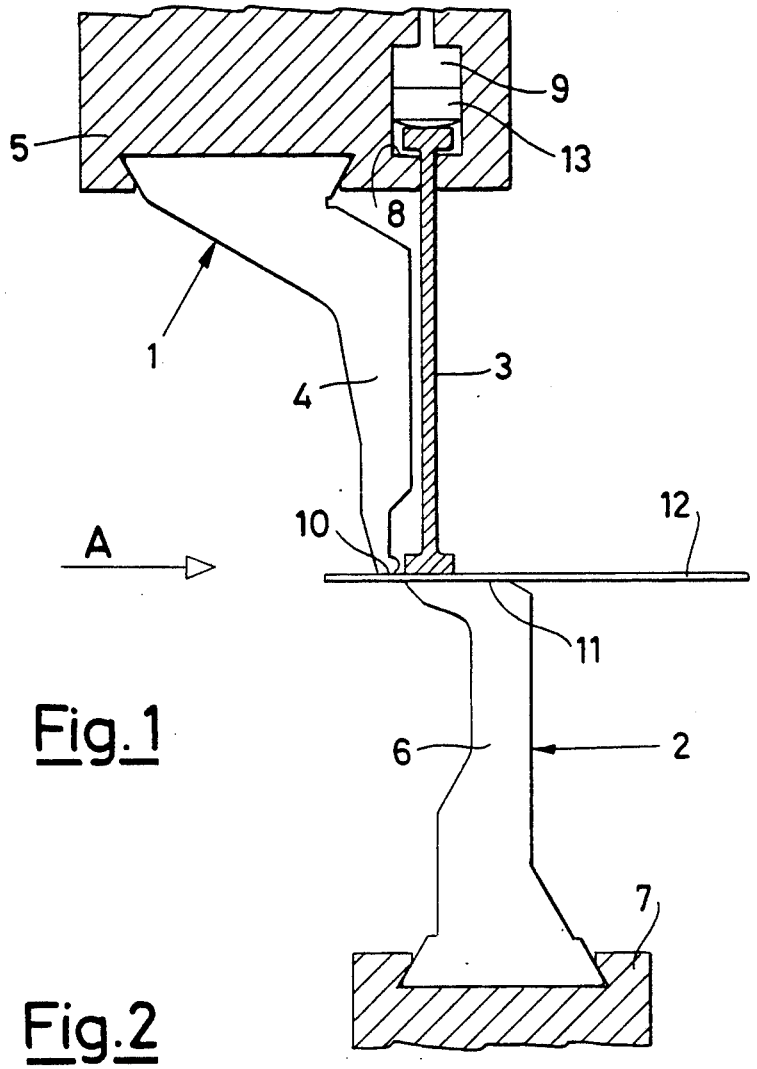
Fig.1
Fig.2
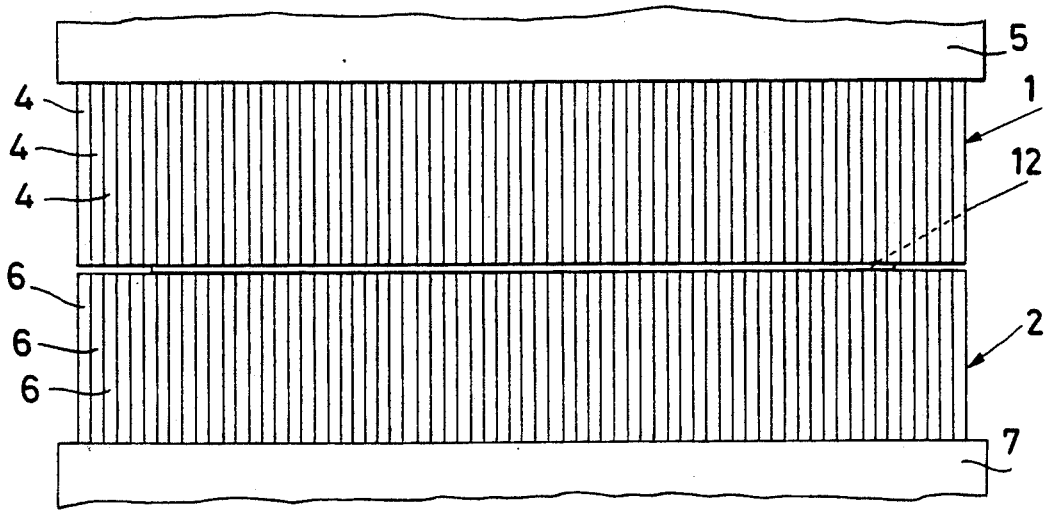

BENDING UNIT OF A MACHINE FOR BENDING METAL SHEETS

BACKGROUND OF THE INVENTION

The present invention relates to a bending unit of a machine for bending metal sheets.

The use is known of bending machines to deform a sheet in a permanent manner from planar to dihedral.

At the end of a well-executed bending operation, the resulting dihedron has planar faces inclined one with respect to the other by the amount required, that is the corner is rectilinear and the angles of all cross-sections perpendicular to the corner are equal to the required angle.

According to the prior art, a first type of bending unit of a bending machine includes two parts: a counterblade constituted by a parallelepiped bar having a length at least equal to the bend to be executed, on one of whose faces there is a V-shaped groove, and a blade also constituted by a parallelepiped bar having a length at least equal to the bend to be executed, one of whose faces is made into a convex V shape. The blade and counterblade, mounted on a single bending machine so that the two V-shaped corners, one concave and one convex, are parallel to one another, are brought together with a suitable force in the rectilinear direction which would bring the corners to coincide, if between them there were not interposed the metal sheet to be bent. The strip of metal sheet between the two edges of the V-shaped groove is thus subjected to a bending moment, at its greatest along the vertex of the convex V, which causes permanent deformation of the metal sheet at a position corresponding to the V-shaped vertex and the formation of a dihedron that much more acute the deeper the blade penetrates into the counterblade.

A second and a third type of bending unit of a bending machine each include three parts, two of which, a counterblade and a metal sheet holder, when they are compressed one against the other, hold one of the edges of the metal sheet adjacent to the future bending corner and leave the other edge free. The third part, the blade, has the function, by moving with respect to the other two and by interfering with the free edge, of deforming the metal sheet.

The second and third type of bending unit differ one from the other in the nature of the motion of the blade in relation to the counterblade and to the metal sheet holder. In the second type of bending unit, the blade has a planar face substantially coincident with a face of the edge to be bent and, in order to execute the bend, this blade rotates with a suitable torque around a straight line which approximately coincides with the corner of the final bend. In the third type of bending unit, the blade touches the edge to be bent along a straight line parallel to a bending corner with a cylindrical face and, in order to execute the bend, the blade translates with a suitable force along a curvilinear trajectory, in particular a rectilinear one, lying in a plane perpendicular to the bending corner.

With the three known bending units, even in the event that the blade moves in an ideal manner, it is not always possible to ensure that a bend will be produced with a rectilinear corner and with the angle constant along its entire length, independently of the thickness and of the length of the bent sheet.

In fact, each part of the bending unit is subjected to forces which vary in the areas facing the metal sheet and to no forces at all in the others. The materials of the areas not subjected to force contribute to the rigidity of the part in the nearby areas under stress more than to that in the far areas under stress. It follows that the bend is more closed in the areas in which the part is more rigid and more open in those in which the part is more flexible, because they are far from those not under stress.

To allow the execution with the same bending machine of several parallel bends on the same metal sheet, even if they are very close to one another, the three parts of the bending unit should have a minimum size sufficient to prevent fatigue breakage under the forces caused by the bending operation. In actual fact, if the sizes of the cross-sections perpendicular to the bending corners of those three parts of the bending unit were to be reduced to the minimum compatible with the resistance, the difference between their deformations in the central part of the bend and in the peripheral areas, which are under the effect of the support of the areas external to the bend, would be so large as to induce unacceptable variations in the bending angle along the bending corner.

In practice, a compromise has had to be adopted up to now, different according to the use of the bent metal sheet pieces, between giving-up the execution of many close-up bends on the same sheet and giving-up a constant bending angle.

SUMMARY OF THE INVENTION

An object of the present invention is to provide a bending unit of the type with blade, counterblade and metal sheet holder, capable of producing bends with a constant angle along the entire length of the bend, with any thickness and length of the metal sheet to be bent.

Another object is to provide a bending unit of the above described type, in which the counterblade, metal sheet holder and blade have cross-sections at the limit of breakage, and thus the profiles which may be accomplished are at the limit of the theoretical capabilities typical of the kind of tool, and at the same time the variation of the bending angle along the bending corner is as small as possible in relation to the type of metal sheet used.

According to the principles of the present invention, such objects are attained by providing a bending unit of a machine for bending metal sheets, including a fixed counterblade, a metal sheet holder which can be applied by pressure on the counterblade so as to hold one of the edges of the metal sheet, and a blade arranged on the same side of the metal sheet holder as the metal sheet translatable with respect to the counterblade and to the metal sheet holder to cause the displacement outside the plane of the edge of the metal sheet which is not held by counterblade and metal sheet holder. The counterblade and blade are made in a plurality of segments which are disposed parallel and side by side to one another in a direction parallel to the plane of the metal sheet. The metal sheet holder is so flexible as to follow the counterblade in its deflections.

Preferably, the abovementioned segments have a thickness which is on the same order of magnitude as the maximum thickness of the metal sheet that is to be bent.

In such a way, by cutting the blade and counterblade into slabs, the connection is cut between their areas subjected to bending forces and thus tending to deflect and their areas not affected by the metal sheet and thus tending to remain undeformed. Maximum deformations are thus allowed only for the counterblade and blade areas which on different occasions are engaged with the metal sheet to be bent.

It should, moreover, be noted that the division into segments of blade and counterblade does not limit the possible size of the length of the metal sheets to be bent. The two extreme segments of the set of segments engaged by a given length of metal sheet not a multiple of the thickness of the segments, which are engaged by the metal sheet for not less than one half of their thickness, even though they are deformed less than the fully loaded contiguous segments, cannot appreciably alter the bending angle at the extremities of the bend, as they are not much thicker than the metal sheet.

In this respect it should be said that it is always possible to load the two extreme segments over more than half their thickness. In a case in which, at a given moment, this does not occur, it is sufficient to move the metal sheet by half a thickness to reduce by one unit the set of segments involved in the bending operation and thus to have two extreme segments covered for more than half of their thickness.

Lastly, the apparent greater complexity of construction of the counterblade and of the blade divided into several segments is overcome by the fact that those two pieces, if they are integral, must be obtained from a forged piece by milling, while, if they are divided into segments, they are obtained by fine-cutting of a strip, with a higher productivity. The present invention, in addition to attaining the pre-established objects, thus also involves a reduction in the cost of manufacture of the bending tool.

BRIEF DESCRIPTION OF THE INVENTION

The features of the present invention shall be made more evident by the following detailed description of an embodiment illustrated as a non-limiting example in the enclosed drawings, wherein:

FIG. 1 shows a sectional view of a bending unit according to the invention with the blade in the position of starting the bending operation;

FIG. 2 is a view along the arrow A of FIG. 1;

DETAILED DESCRIPTION

Figure 3:
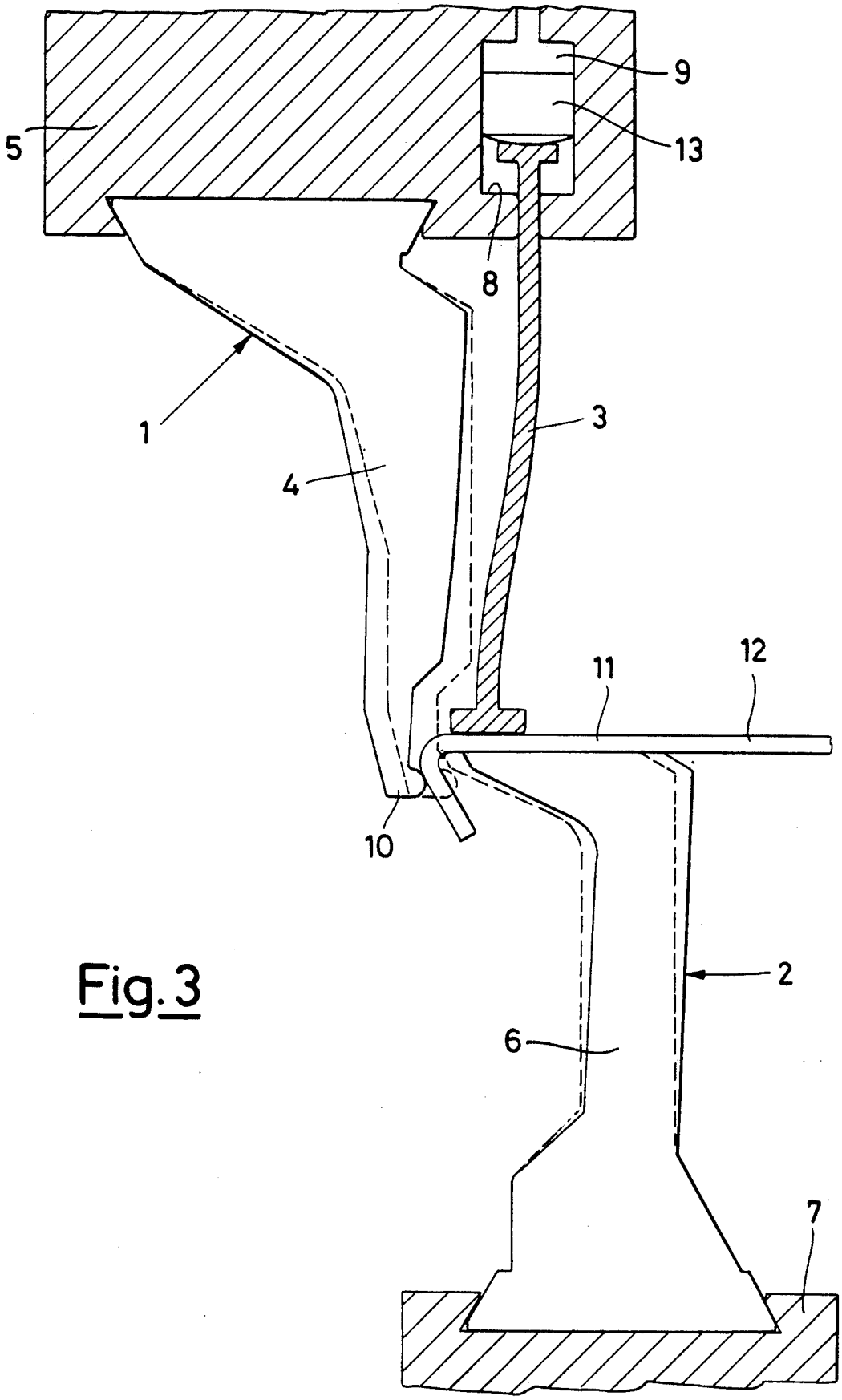
FIG. 3 is a sectional view of the bending unit in which there is shown with a continuous line the position of blade and counterblade during the bending step of a metal sheet.

With reference to FIGS. 1 and 3, there is shown a bending unit of a bending machine which comprises a blade 1, a counterblade 2 and a metal sheet holder 3.

As illustrated in FIGS. 1 and 2, the blade 1 is constituted by a plurality of segments 4 placed side by side relative to one another, held by known means in a swallow-tail slot of a carriage 5, and ending with an active edge 10. The thickness of the segments 4 is substantially of the same order of magnitude as the maximum thickness of the metal sheet to be bent.

Similarly, the counterblade 2 is constituted by a plurality of segments 6 having the same thickness as segments 4, placed side by side to one another and held by known means in a swallow-tail slot of a part of the base 7 of the bending machine. The free ends of such segments 6 define a plane 11, against which there is placed a metal sheet 12.

The metal sheet holder 3 is made in a single piece having an I cross-section held against an abutment 8 of carriage 5 by a series of small pistons 13 which slide in hydraulic cylinders 9, of which only one is represented in FIGS. 1 and 3, incorporated in carriage 5 itself.

The bending operation is executed in the following manner:

Initially carriage 5 moves, with a small force and at a high speed, in a perpendicular approach to plane 11 to bring blade 1 and metal sheet holder 3 near metal sheet 12 arranged against the abovementioned plane.

At the same time, carriage 5 moves in a direction parallel to plane 11 for the initial positioning of blade 1 and of metal sheet holder 3 with respect to counterblade 2, calculated in relation to the thickness of the metal sheet 12 to be cut, to the bending angle to be produced and to the required bending radius.

The actual bending operation occurs due to the effect of a further movement of carriage 5 perpendicular to plane 11, possibly followed by a movement of the same carriage 5 parallel or almost parallel to plane 11.

These two movements of carriage 5 are executed with great force and at a low speed, compatible with the power available, and are in relation to the quality of the metal sheet 12 to be bent, to its thickness, to the length and to the angle and to the radius of the bend.

Due to the effect of the bending stroke of carriage 5 perpendicularly to face 11, the metal sheet holder 3, which has stopped against metal sheet 12 held against counterblade 2, causes the return of the small pistons 13 of cylinders 9, of which only those totally engaged against the metal sheet are under pressure, while those not engaged are not under pressure, and those partially engaged are held at a pressure proportional to the portion of their area engaged by the metal sheet. The adjustment of said pressures is made with conventional means.

Subsequently, carriage 5 translates away from counterblade 2, in a direction parallel and perpendicular to plane 11, with a small force and at a high speed to allow the removal of the bent metal sheet 12.

There is shown in FIG. 3, in an exaggerated manner, with continuous lines, the deformation of metal sheet holder 3 and of segments 4 and 6 of blade 1 and of counterblade 2, engaged by the metal sheet 12, at the end of the bending operation; with dotted lines there are, on the other hand, shown the segments which are not engaged and are thus not deformed. Metal sheet holder 3, since it is not divided into segments, is deformed in a uniform manner along the entire part which touches metal sheet 12, because the force produced by cylinders 9 is such as to generate a friction which does not allow the sheet to slip with respect to metal sheet 12 and to counterblade 2, because its resistance to deflection and twist is designed to be low and because its areas which are not engaged, again due to their low resistance to deflection and twist, make a small contribution to the rigidity of the engaged area.

I claim:

1. A bending unit for a machine for bending into dihedral form an initially planar metal sheet having a given thickness which lies within a known thickness range, which sheet, along an edge thereof has an edge portion, which is to be bent along an axis which is parallel to opposite faces of the sheet, so that, after bending, said edge portion extends at a non-180° angle relative to a remaining portion of said sheet, which remaining portion adjoins said edge portion at a linear bend formed by said bending unit, said bending unit comprising:

a generally fixed counterblade comprising a plurality of engagingly laterally adjoining individual segments mounted in a base so as to have free ends providing respective, normally coplanar support plane means for supporting thereon said initially planar metal sheet with said edge portion of said sheet cantilevered so as to freely project beyond said support plane means;

a sheet holder arranged to engage said sheet on an opposite side of said sheet from said counterblade, so as to hold a band of what is to become said remaining portion of said sheet, beside where said bend is to be formed, against said support plane means on said free ends of said counterblade; said sheet holder comprising: a foot flange and a head flange formed so as to extend parallel to one another at opposite ends of an integral, compressibly flexible web extending perpendicular to said support plane means, a carriage mounted for movement towards and away from said support plane means, and means mounting said head flange to said carriage, so that movement of said carriage towards and away from said support plane means can apply, via said web and said foot flange, variable squeezing force on said band of said sheet against said counterblade; and a blade mounted to said carriage beside said sheet holder, so as to be located on a same side of said sheet, before bending of said sheet, as said sheet holder and on an opposite side of said sheet, before bending of said sheet, as said counterblade; said blade comprising a plurality of engagingly laterally adjoining individual segments mounted in said carriage so as to have free active edges arranged to engage said cantilevered edge portion of said sheet beside where said bend is to be formed;

said free active edges of said blade being normally disposed so close to said carriage, that, in order to accomplish said bending as said carriage moves towards said counterblade, said foot flange of said sheet holder must move towards said carriage, which movement is accommodated at least in part by flexure of said web in compression.

2. The bending unit of claim 1, wherein:

each said segment of said counterblade and each said segment of said blade has a thickness which is approximately equal to the largest thickness within said known thickness range.

3. The bending unit of claim 1, wherein:

said means mounting said head flange to said carriage comprises a fluid pressure-operated piston and cylinder arrangement interposed between said head flange and said carriage and arranged to exert a variable pressure on said head flange for adjustably compressively flexing said web and thereby adjustably squeezing said sheet against said segments of said counterblade as said segments of said blade bend said edge portion of said sheet along said bend.

* * * * *